United States Patent [19]

Sohner et al.

[11] 4,185,603

[45] Jan. 29, 1980

[54] SUPPLY VOLTAGE VARIATION COMPENSATED IGNITION SYSTEM FOR AN INTERNAL COMBUSTION ENGINE

[75] Inventors: Gerhard Söhner, Geradstetten; Gerd Höhne, Ludwigsburg; Peter Werner, Stuttgart; Ingo Gorille; Herman Roozenbeek, both of Schwieberdingen, all of Fed. Rep. of Germany

[73] Assignee: Robert Bosch GmbH, Stuttgart, Fed. Rep. of Germany

[21] Appl. No.: 865,578

[22] Filed: Dec. 29, 1977

[30] Foreign Application Priority Data

Jan. 8, 1977 [DE] Fed. Rep. of Germany ..... 2700677

[51] Int. Cl.[2] ..... F02P 3/04

[52] U.S. Cl. ..... 123/148 E

[58] Field of Search ..... 123/148 E, 117 R, 117 D; 315/209 T

[56] References Cited

U.S. PATENT DOCUMENTS

| | | | |
|---|---|---|---|
| 3,666,989 | 5/1972 | Boyer | 315/219 |
| 3,841,288 | 10/1974 | Korteling | 123/148 E |
| 3,881,458 | 5/1975 | Roozenbeek et al. | 123/117 R X |
| 3,937,193 | 2/1976 | Kim | 123/148 E X |

*Primary Examiner*—Tony Argenbright

*Attorney, Agent, or Firm*—Frishauf, Holtz, Goodman & Woodward

[57] ABSTRACT

To operate an ignition control transistor, connected into the primary ignition coil under minimum saturation condition regardless of voltage level of the supply voltage, delivered, for example, from the battery of an automotive vehicle, at least one timing circuit is connected to the voltage supply to have a timing interval which varies as a function of supply voltage, the timing interval controlling the duration of current flow through the transistor as a function of supply voltage so that the transistor will be conductive for the required time to store magnetic energy in the coil, though not for an excessively long period of time regardless of the level of supply voltage within the limits normally experienced in automotive ignition systems.

15 Claims, 5 Drawing Figures

REFERENCE VOLTAGE SOURCE
POWER SUPPLY TERMINAL
Us'

U2 < U1
U1
α %
n
Us
U/I
t
A
B
C
D
E
F

SUPPLY VOLTAGE VARIATION COMPENSATED IGNITION SYSTEM FOR AN INTERNAL COMBUSTION ENGINE

Cross reference to related application, assigned to the assignee of the present application:

U.S. Ser. No. 865,577, filed Dec. 29, 1977, FRESOW et al.

The present invention relates to an ignition system for an internal combustion engine, and more particularly to an ignition system for an automotive-type internal combustion engine in which variations of supply voltage to the ignition system are automatically compensated, so that the ignition system will operate at maximum efficiency at all times regardless of the level of the supply voltage.

BACKGROUND AND PRIOR ART.

Ignition systems, and particularly transistor-controlled ignition systems are known. It has been previously proposed to vary the closed, or ON-TIME of the transistor switches independence on speed of the engine, so that the controlled transistor which controls opening and closing of the circuit through the primary of the ignition coil operates at its most efficient levels, just in saturation, but not remaining in saturated state for any appreciable period of time. If the supply voltage to the system varies widely-as is frequently the case in on-board automotive vehicle networks—it is difficult to maintain the operating efficiency of the final control transistor at optimum level, that is, to operate the control transistor so that it has just reached saturation, but does not remain in saturation, when it is controlled to be conductive. If the supply voltage is a battery then the ON-TIME, or closed time of the transistor switch must be so adjusted that the transistor will operate in saturation when the battery voltage is at its normal or design level, yet, that saturation conditions also pertain when the battery is close to being discharged. It is difficult to satisfy both requirements so that usually if the circuit is so arranged that, with fully charged battery the saturated condition of the transistor is properly obtained, the energy stored in the ignition coil when the battery is substantially discharged is decreased considerably.

The Invention

It is an object of the present invention to provide optimum closed, or ON-TIME of a control switch, typically a transistor switch even if the battery supply voltage to the transistor switch varies widely, so that losses in associated circuitry, the ignition coil, and any resistor losses are minimized. Additionally, it is an object to so arrange a transistor controlled switching circuit that the ON-TIME of the transistor switch is extended when the battery voltage is low, for example while an engine is being started, to provide optimum ignition energy while minimizing loading of the on-board network, and components of the ignition system under normal operating conditions.

Briefly, at least one timing circuit is provided, connected to the voltage supply source and establishing at least one timing interval as a function of the level of the supply voltage, typically the battery of an automotive vehicle. The at least one timing circuit is connected to control the closed time, or ON-TIME of a controlled switch, typically a transistor serially connected to the primary of an ignition coil of the ignition system as a function of the at least one timing interval, so that current flow through the switch is controlled in dependence on the level of the voltage of the supply source, that is, typically, the battery supplying the on-board network of an automotive vehicle.

The timing circuit, in accordance with a feature of the invention, can be a current control circuit controlling the charge rate, and/or discharge rate, respectively, of a capacitor, in combination with a comparator, in which the capacitor voltage is compared with a reference level, the output signal of the comparator being connected to the circuit controlling closing of the control switch, typically the control transistor, for the ignition system. The controlled current source, in turn, is controlled by a transducer system connected to the crankshaft of the engine and providing a control pulse to the ignition system at a predetermined angular position, with respect to top dead center (TDC) position of a piston thereof. The outputs from the comparator then can be used to additionally control, or override closing of this transistor ignition switch or adding, or substracting, respectively, the comparator signal to the signal derived from the ignition control transducer. The closing/opening relationship, that is, ON/OFF timing, or duty cycle of the transistor switch controlling current flow through the ignition coil thus can be matched to the speed of the engine as well as to battery voltage. Consequently, at low battery voltage, the ignition voltage available from the secondary is only slightly decreased, and at high operating voltage, both the transistor and the ignition coil are protected against excessive currents.

In accordance with a preferred feature, a second timing circuit is used to set the minimum open-time of the switch, connected in parallel to the first timing circuit. This permits maximum current flow under optimum conditions at high speeds of the engine, and thus high ignition voltage under high speed conditions. Further, a remaining energy storage effect can be obtained, particularly at low battery voltages, that is, the primary current can be reconnected before all the energy of the magnetic field thereof and stored therein has been dissipated. As the speed changes, the transition conditions are improved.

The system has the advantage that optimum closed time or ON-TIME of the ignition control switch, typically a transistor is obtained even if the battery voltage supplying the system varies widely. As the battery voltage increases, ON-TIME decreases; as the battery voltage decreases, the ON-TIME of the switch increases, so that the energy stored in the coil will be effectively constant. Heat losses occurring within the system, within the coil, and resistors connected thereto are minimized. Additionally, the ignition energy obtained on the starting condition is substantially improved since, during starting, which usually means a low battery voltage, the ignition voltage is maintained by increasing the ON-TIME of the ignition coil control switch. Overall, the on-board network of vehicle is subjected to minimum loading, consistent with optimum operation of the ignition system under widely varying conditions.

DRAWINGS ILLUSTRATING AN EXAMPLE

Figures 1, 2, 3:
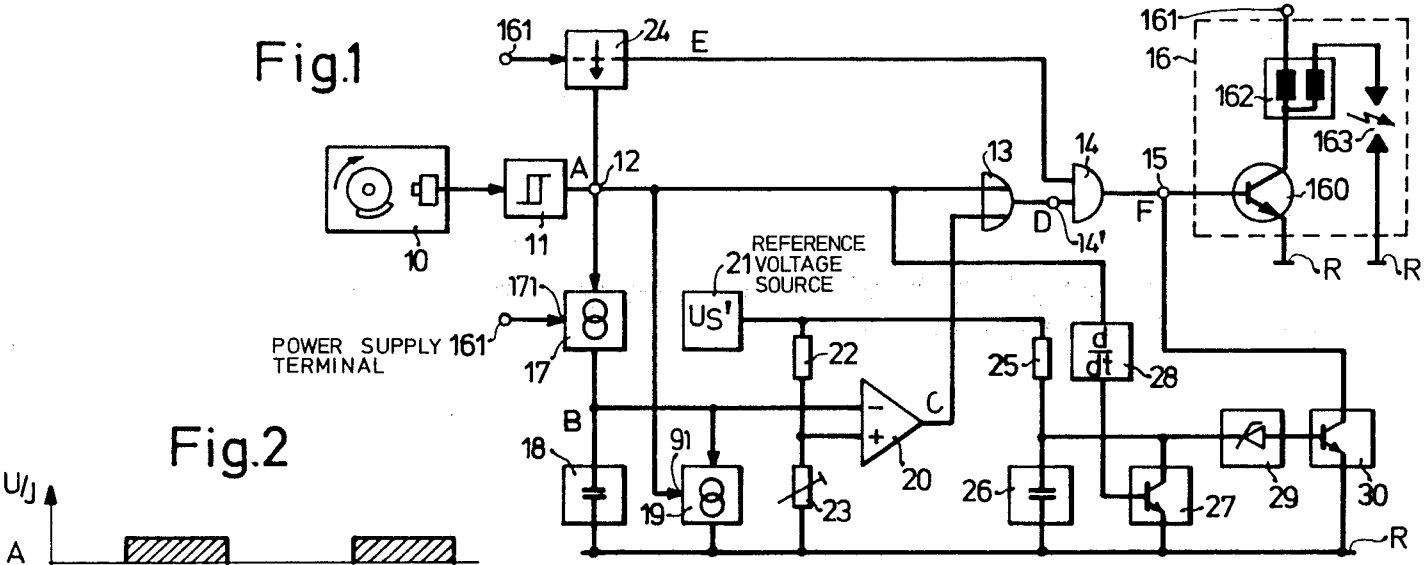
FIG. 1 is a schematic, partly block diagram of an embodiment of the invention.
FIG. 2 is a series of graphs illustrating signal pulses in the system of FIG. 1, wherein the graphs are lettered with signals appearing at similarly lettered junctions in the circuit diagrams.
FIG. 3 is a graph illustrating the relationship of closing time, represented as a percentage of angle of rotation of the crankshaft of the engine (ordinate) with respect to engine speed (abscissa)

A battery (not shown) supplies power to the system at power supply terminals 161 (FIG. 1). The engine (not shown) has its crankshaft coupled to a pulse generator connected to a junction 12. The signal at junction 12 may be obtained in various ways, the illustration of an inductive transducer 10 coupled to a trigger circuit 11 being merely exemplary; the pulse source 10 may be a breaker contact, a Hall generator, or other magnetic elemental system, or terminal 12 can be coupled to an ignition control system of known type, and of desired complexity to control the ignition timing as a function not only of speed of the engine but of other parameters, such as loading, temperature, and the like. The output terminal 12 is connected through an OR gate 13 to AND gate 14 to a terminal 15. Terminal 15 forms the input terminal of the ignition control power stage 16 which, as schematically shown, is connected to the control input of an electronic switch 160, typically to the base of a transistor 160. The base of the transistor itself may be a Darlington-connected circuit, or other semiconductor control switch. Circuit 16 is connected to the power supply terminal 161 through the primary of an ignition coil 162, the emitter of switch 160 being connected to ground, or chassis, or reference potential R and forming the other terminal of power supply 161. The junction between the switch 160 and the primary of ignition coil 162 is connected to the secondary of the ignition coil, the outer terminal of which is connected to a spark gap 163, typically a spark plug. A distributor can be interposed between the secondary of coil 162 and spark plugs 163, as well-known, if the system is to be used with a multicylinder internal combustion engine.

A controlled current circuit 17, serially connected with a capacitor 18 is connected between terminals 12 and reference R. Control of circuit 17 is obtained in dependence on supply voltage, applied at a control terminal connected to terminal 161. The control terminal 171 controls current flow through circuit 17 as a function of supply voltage thereat, that is, as a function of the voltage terminal 161. Such a controlled current circuit may, for example, be a transistor having its emitter-collector path connected between terminals 12 and the capacitor 18, and its resistance, or current passage controlled as a function of supply voltage 161 connected, for example via a voltage divider, to the base thereof. Such circuits are well-known. The junction point between the controlled current circuit 17 and capacitor 18 is connected to one terminal of a comparator 20 which, for example, may be an operational amplifier. The output of comparator 20 is connected to the second input of OR gate 13.

A second controlled current circuit 19 is connected in parallel to capacitor 18. The second controlled circuit 19 forms a controlled discharge circuit for capacitor 18. Change of resistance of the controlled current circuit 19, that is, whether in blocked condition or in passing condition, and then, at what resistance level, is controlled by terminal $^{19}$ which is connected to terminal 12. Circuits 17 and 19 may be similar. A reference voltage source 21, providing a reference voltage Us'is connected through two resistors 22,23, forming a voltage divider, and of which one of them is variable, herein shown as resistor 23. The tap point of the voltage divider is connected to the comparison input of comparator 20, as shown, to the direct input of an operational amplifier.

The system includes a third timing circuit 24, connected to junction 12. The third timing circuit 24 is a monostable multivibrator (MMV), the output of which is connected to the second input of AND gate 14. The MMV 24 is controlled and supplied by the power terminal 161, connected to the control input of MMV 24 to control the unstable time thereof as a function of supply voltage. Such voltage controlled MMVs are known. They may include, for example, a capacitor, the charge rate of which is controlled by a voltage controlled current source. Another circuit which can be used is to couple the supply voltage to the emitter of a threshold transistor through a voltage divider in such a manner that the divided voltage, representative of input voltage, forms the emitter voltage of the threshold transistor of the monostable MMV.

The stabilized voltage source 21 is connected to a charge resistor 25 and a second capacitor 26 to reference or chassis potential in order to eliminate quiescent currents. A discharge transistor 27 is connected in parallel to the capacitor 26, the discharge transistor 27 being controlled by a differentiating circuit 28 which is connected to terminal 12. The junction between the charge resistor 25 and the capacitor 26 is connected through a threshold stage 29, preferably a Zener diode to the base of the control transistor 13, the emitter-collector path of which is connected between terminal 15, forming the output AND gate 14 and reference R.

Operation, with reference to FIGS. 2 and 3: The signal controlling current flow, and accurately timed interruption of current flow to generate the spark is applied at terminal 12. In the example shown, the signal is derived from transducer 10 transformed in the wave shaping stage 11 into the square wave signal A. The geometry of the rotor of the transducer 10 can be so set that a duty cycle of, for example, 40% is normally obtained (as shown, ON-TIME about 40% of the total cycling time of ON plus + OFF). The signal A triggers connection of the first controlled circuit 17, functioning as a controlled current source, and blocking of the second controlled current circuit 19, forming a controlled circuit discharge path. Capacitor 18 will charge at the controlled current rate through circuit 17, the charge current being indicated at graph B. At the termination of the signal A, current source 17 blocks and the discharge circuit 19 is energized. Capacitor 18 discharges, at a controlled rate, through circuit 19. Voltage divider 22,23 provides a threshold level voltage Us through the comparator 20. When the threshold level Us is passed by the voltage of capacitor 18, comparator 20 provides a signal C. This signal C is summed in OR gate 13 with the signal A providing an output OR gate 13 signal D. The trailing flank of the signal A is used to trigger the MMV 24. Consequently, the output signal E from MMV, and taken from a complementary terminal thereof disappears. AND gate 14, therefore, will block for the duration of the ON-TIME of MMV 24. Terminal 15 will thus have the signal F thereon which is used to control the transistor 160 if desired over driver or preamplifier stages, to provide a control time for the transistor 160. During the ON-TIME or conductive time period of transistor 160, current will flow in the primary of coil 162. At the termination of the closed, or ON-TIME of transistor 160, transistor 160 will rapidly block, thus triggering a spark across spark plug 163. The ON-TIME, or conductive time of transistor 160 is so arranged that current there/through just reaches saturation, but does not remain in the saturated region, in order to decrease heat losses and to protect the components and operate them under optimum conditions of use and efficiency.

Effect of speed variation: If the speed drops, the threshold voltage Us is exceeded by the capacitor voltage of capacitor 18 for a longer period of time, so that the signal S will, essentially, correspond to the signal A which, under low speed conditions, will be substantially longer than shown in FIG. 2. The ratio between the angular variation upon rotation of the crankshaft and open time will remain approximately constant, and the duty cycle will vary only slightly. As the speed increases, the threshold level Us is exceeded for shorter and shorter time periods, so that the charge time and discharge time of capacitor 18 becomes shorter and shorter. As the speed increases, the ratio of the closed time to the overall cycling time increases, as seen in FIG. 3. This increase extends until the minimum open-time is obtained set by the MMV 24, that is, until the signal D is longer than the signal E. In this case, signal F no longer will conform to the signal D, but rather will conform to the signal E. There will be no change in percent of the relative ratio of closed time of the switch 160 with respect to overall cycling time as the speed n increases.

Effect of change of voltage of power supply at terminal 161: The controlled current source 17, as well as the MMV 24 are controlled by the level of supply voltage. As illustrated in FIG. 3, the supply voltage curve is raised as battery voltage drops. Curve U1 illustrates the condition at higher voltage, for example at nominal supply voltage; curve U2 shows the relationship when the supply voltage drops. Raising the flat or horizontal portion of the curve is provided by the voltage control of MMV 24 which, if there is a higher voltage, provides for longer unstable time, and hence a longer ON-TIME thereof. The raising of the rising portion of the curve is obtained by voltage control of the controlled current source 17, which, with higher voltage, provides a higher charging current to capacitor 18.

Modifications: In principle, it is possible to provide for additionally voltage control of controlled source 19, and then omitting the voltage control of source 17, or using voltage control for both sources 17, 19. It is also feasible to provide a varying reference level at comparator 20 by changing the voltage Us' of the reference voltage source 21 in dependence on the voltage of the power supply terminal 161, so that the voltage taken off the voltage divider 22,23 will act as a variable reference to shift the threshold level of comparator 20.

Figure 4:
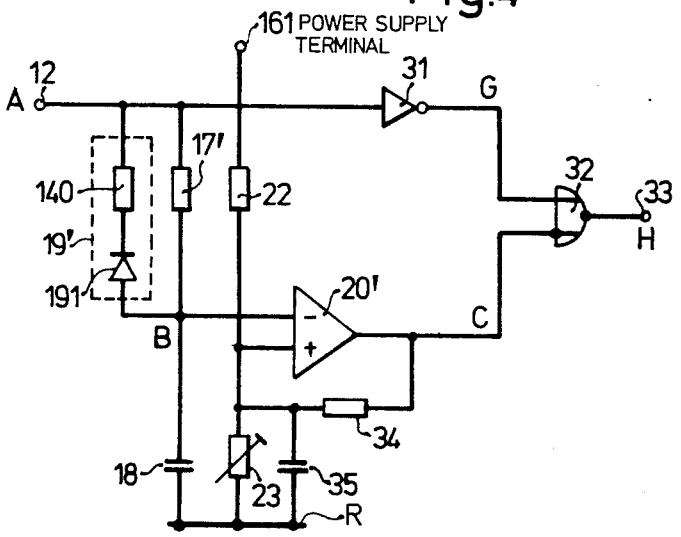
FIG. 4 is a fragmentary diagram of another embodiment of the invention, and replacing a portion of the diagram of FIG. 1.

Embodiment of FIG. 4: The system of FIG. 4 replaces elements to the right of terminal 12 and to the left of terminal 15, as will be described. Components and terminals previously described and having essentially the same function will not be described again and have been given the same reference numerals, and if only generally similar, the same reference numerals with the prime notation.

The charge current supply circuit for capacitor 18 is a resistor 17', and thus is not a controlled source. The discharge circuit 19', in parallel to the charge circuit 17' likewise is not controlled and includes a resistor 119 and a decoupling diode 191. The voltage divider 22,23 controlling the comparator 20' is connected to power supply terminal 161, thus provides a variable comparison level to the comparator 20'. Terminal 12 is connected through an inverter 31 to the input of a NOR gate 32, the output of which is connected to a terminal 33. Terminal 33 can be connected into the network of FIG. 1 as follows: If the signal H at terminal 33 is to determine the closed time of the switching transistor 160, then terminal 33 is connected to terminal 15 (FIG. 1).

If a minimum open-time should additionally be desirable, as explained in connection with MMV 24, FIG. 1, then terminal 33 is to be connected to terminal 14' of AND gate 14, replacing the corresponding output terminal from OR gate 13, which, in FIG. 4, corresponds to NOR gate 32.

The output of comparator 20' is connected to the second input of NOR gate 32. The comparator 20' has hysteresis, obtained by connecting a positive feedback resistor 34 between the output and the direct input thereof. A decoupling capacitor 35 is connected between the direct input of comparator 20' and reference potential, that is, in the positive feedback circuit. Capacitor 35 is a decoupling capacitor which additionally has a function in the positive feedback and reduces, in combination with a positive feedback resistor $^{34}$, stray noise or interference signals.

Figure 5:
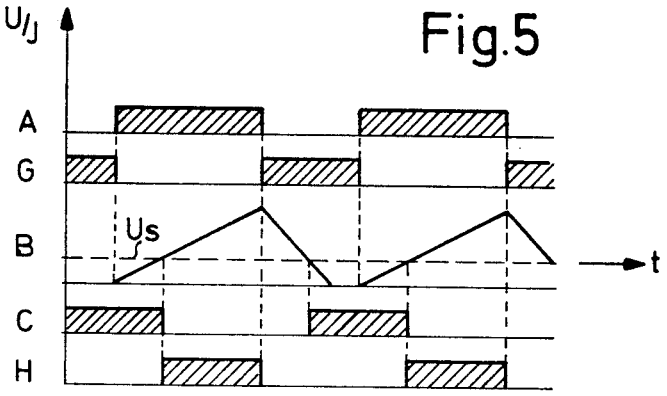
FIG. 5 is a series of graphs, similar to FIG. 2, but pertaining to the system of FIG. 4.

Operation of circuit of FIG. 4 with reference to FIG. 5:

The signals A, B, C are generated similar to the generation of the signals as described in connection with FIGS. 1–3. If charge and discharge of the capacitor 18 is to be symmetrical, then the second controlled current circuit 19' can be omitted, and capacitor 18 will discharge only over the resistor 17'. In a preferred form, however, the discharge circuit is so arranged that discharge is more rapid than charge of the capacitor so that the system would operate reliably even at high engine speed. Signal G is the inverted signal, or the complement to the signal A. NOR gate 32 logically combines the signals C, and G to form the signal H. In effect, the overlapping portion of the signal C is subtracted from the signal A. The signal length, in percent, of the signal A must be somewhat longer for this embodiment. If the supply voltage decreases, then the threshold level Us will also decrease, thus decreasing the length of the signal C. Decreasing the length of the signal C, in turn, causes an increase in the length of signal H. Again, as in the embodiment in connection with FIGS. 1–3, the percentage-ON, or closed time rises as the supply voltage decreases.

The inverter 31 is not strictly necessary, and the NOR gate 32 can likewise be omitted, so that the output of the comparator 20 is connected directly to the terminal 33 if the time constant of the discharge circuit 19' is sufficiently short. If discharge is rapid, the end of the signal A will be approximately coincident with the beginning of the signal C, since the discharge characteristic of the capacitor will be steeper than as shown in FIG. 5. If the inverting and direct input of the comparator 20' are then inverted, the signal C will become almost identical to the signal H.

The circuit as described could be used directly to provide for voltage correction of the supply source with any semiconductor controlled ignition switch, regardless of source of the control signal A which govern the operation of the switch 160. For example, the circuits can also be used to correct for voltage variations of complex ignition control systems, for example digital ignition control system. If so use, terminal 12 is not directed to a transducer 10 and, if needed, suitable wave shaping circuits but rather through the output of an ignition angle control unit.

Various changes and modifications may be made and each is described in connection with any one of the embodiments can be used with any of the others, within the scope of the inventive concept.

We claim:

1. Supply voltage variation compensated ignition system for internal combustion engine having a source of voltage supply (161);

an ignition coil (162);

a control switch (160) in series with the primary of the ignition coil (162), and, selectively connecting and disconnecting current flow through the primary of the ignition coil from said source of supply voltage;

means (10, 11) controlling opening and closing, selectively, of said control switch (160) in dependence of rotation on the shaft of the engine;

and comprising, in accordance with the invention at least one timing circuit (17, 18, 19, 20; 24; 17', 18', 19',22,23,25) including a capacitor (18), a capacitor charge circuit (17) and a capacitor discharge circuit (19) for said capacitor, at least one of said capacitor circuits being controllable, and a comparator circuit having the voltage appearing at said capacitor (18) applied to one comparison input thereof, the other comparison input being connected to a source (21, 161) of threshold voltage ($U_s$), the output of said comparator (20) being connected to said control switch (160) to provide a signal therefore controlling closing of said switch, said timing circuits being connected to the source of voltage supply (161) and establishing at least one timing interval additionally controlling the closed time of said control switch (160) as a function of said at least one timing interval to control the commencement of current flow through said controlled switch, after a preceding interruption thereof, in dependence on the level of the voltage of said supply source (161) with respect to said source (21) of threshold voltage.

2. System according to claim 1 further including connections means (13) interconnecting said opening and closing control means (10,11) and said controlled switch (160) to control closing and opening of said controlled switch in dependence on command of said control means.

3. System according to claim 1 further including a logic circuit (31,32) interconnected between the output of said comparator (20) and the control terminal of said control switch (160) and logically combining the output of said opening and closing control means (10,11) and said comparator and controlling said controlled switch to close if:

(a) an output signal from said opening and closing control means (10,11) is present and (b) the comparator provides a signal indicative that the capacitor voltage is below the threshold level of the comparator reference voltage.

4. System according to claim 1 wherein at least one of said capacitor circuits is a controlled circuit connected to and controlled by the voltage level of said source of voltage supply (161).

5. System according to claim 1 wherein the reference voltage applied to said comparator (20,20') is representative of and a function of the voltage level of the source of voltage supply (161).

6. System according to claim 5 further including a voltage divider (22,23) connected to one of the comparison inputs of the comparator (20,20') and determining the comparison of the threshold level thereof.

7. System according to claim 1 wherein the comparator comprises an operational amplifier having a feedback resistor (34) connected between the output and one input thereof.

8. System according to claim 7 further including a filter capacitor (35) connected between the junction of the feedback resistor (34) and said input, and a terminal of the source of voltage supply (161).

9. System according to claim 1 wherein said system comprises two timing circuits, one timing circuit controlling the closing of said control switch after having opened on the command of said opening and closing control means (10,11) and the second timing circuit (24) controlling a minimum open-time of said control switch (160) until the next subsequent closing thereof.

10. System according to claim 9 wherein said second timing circuit (24) has its timing interval controlled as a function of the voltage level of said source of voltage supply (161).

11. System according to claim 9 further including logic means (14) connecting the output of said second timing circuit (24) and said first timing circuit, the second timing circuit being connected to and controlled by said opening and closing control means (10,11) to initiate a second timing interval upon sensing a signal from said opening and closing control means commanding opening of said controlled switch (160), the logic circuit (14) logically combining the output signals of said first timing and commanding opening of said control switch (160) during the timing interval determined by said second timing circuit.

12. System according to claim 11 wherein said second timing circuit (24) has its timing interval controlled as a function of the voltage level of said source of voltage supply (161).

13. System according to claim 1 further including a quiescent current disconnect circuit (25-30) connected to the control circuit of said controlled switch (160) to inhibit flow of control current to said controlled switch unless said controlled switch is supplied with periodically recurring control signals from that opening and closing control means (10,11).

14. System according to claim 13 wherein said quiescent current disconnect means includes a differentiator (28) connected to and receiving signals from said opening and closing control means (10,11);

a further capacitor (26) connected to a further charge circuit (21,25) therefore, and a discharge switch (27) controlled by said differentiator (28);

and means (29,30) connected to said capacitor and applying capacitor voltage from said further capacitor (26) to said controlled switch (160) to cause opening of said controlled switch unless the further capacitor is discharged by said discharge switch

(27) as controlled by the differentiated signals from said opening and closing control means (10,11).

15. System according to claim 1 wherein the capacitor charge circuit (17) is connected to said source of voltage supply (161) to charge the capacitor (18) to a level dependent on the voltage level of said source of voltage supply.

* * * * *